US010087686B2

(12) United States Patent
Nordstrand et al.

(10) Patent No.: US 10,087,686 B2
(45) Date of Patent: Oct. 2, 2018

(54) SHANK ADAPTOR WITH STRENGTHENED FLUSHING HOLE

(71) Applicant: SANDVIK INTELLECTUAL PROPERTY AB, Sandviken (SE)

(72) Inventors: Anna Nordstrand, Gavle (SE); Petri Ahola, Gavle (SE); Rasmus Hemph, Gavle (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/578,737

(22) PCT Filed: May 2, 2016

(86) PCT No.: PCT/EP2016/059729
§ 371 (c)(1),
(2) Date: Dec. 1, 2017

(87) PCT Pub. No.: WO2016/192910
PCT Pub. Date: Dec. 8, 2016

(65) Prior Publication Data

US 2018/0171723 A1 Jun. 21, 2018

(30) Foreign Application Priority Data

Jun. 4, 2015 (EP) ..... 15170715

(51) Int. Cl.
*E21B 17/18* (2006.01)
*E21B 21/12* (2006.01)
*E21B 17/03* (2006.01)
*E21B 6/00* (2006.01)
*E21B 6/04* (2006.01)
(Continued)

(52) U.S. Cl.
CPC ..... *E21B 17/03* (2013.01); *E21B 6/00* (2013.01); *E21B 6/04* (2013.01); *E21B 17/04* (2013.01); *E21B 17/16* (2013.01)

(58) Field of Classification Search
CPC ..... E21B 17/04; E21B 17/18; E21B 21/12
See application file for complete search history.

(56) References Cited

U.S. PATENT DOCUMENTS 3,360,047 A * 12/1967 Burnett ..... E21B 17/04 137/67
3,554,306 A * 1/1971 Wilburn ..... E21B 10/38 175/320
(Continued)

FOREIGN PATENT DOCUMENTS

EP 1077305 A1 2/2001
EP 2851502 A1 3/2015
(Continued)

*Primary Examiner* — Kenneth L Thompson
(74) *Attorney, Agent, or Firm* — Corinne R. Gorski

(57) ABSTRACT

A rock drilling shank adaptor has at least one flush hole extending radially through the body of the adaptor in communication with an axially extending internal bore. The flush hole in a direction from an external side to an internal side includes a surface at a rearward region that is curved at least at a radially inner portion to extend in an axial direction towards a forwardmost end of the adaptor to increase the resistance of the adaptor to stress concentrations whilst achieving a desired flow rate of flushing fluid flow into the internal bore.

15 Claims, 4 Drawing Sheets

(51) Int. Cl.
*E21B 17/04* (2006.01)
*E21B 17/16* (2006.01)

(56) References Cited

U.S. PATENT DOCUMENTS 4,094,364 A 6/1978 Lundstrom et al.
4,479,558 A * 10/1984 Gill ..... E21B 41/0078 175/320
4,549,615 A * 10/1985 Liang ..... E21B 7/001 175/389
4,657,092 A * 4/1987 Franks, Jr. ..... E21B 17/18 175/232
5,366,030 A * 11/1994 Pool, II ..... E21B 17/18 175/215
6,491,097 B1 * 12/2002 Oneal ..... E21B 17/1085 166/169
6,736,226 B2 * 5/2004 Broom ..... B23B 51/00 175/320
7,011,158 B2 * 3/2006 Davis ..... B08B 9/0433 166/177.7
2006/0283636 A1 * 12/2006 Reagan ..... E21B 4/02 175/107
2013/0206482 A1 * 8/2013 Reimers ..... E21B 10/60 175/324
2013/0233620 A1 * 9/2013 Rankin ..... E21B 21/103 175/57
2016/0215569 A1 * 7/2016 Hemph ..... E21B 1/02

FOREIGN PATENT DOCUMENTS

GB 2212747 A 8/1989
SE 0201372 L 11/2003
WO 2004079152 A1 9/2004
WO 2008133584 A1 11/2008
WO 2013109182 7/2013

* cited by examiner

SHANK ADAPTOR WITH STRENGTHENED FLUSHING HOLE

RELATED APPLICATION DATA

This application is a § 371 National Stage Application of PCT International Application No. PCT/EP2016/059729 filed May 2, 2016 claiming priority to EP Application 15170715.5 filed Jun. 4, 2015.

FIELD OF INVENTION

The present invention relates to a rock drilling shank adaptor and in particular, although not exclusively, to a shank adaptor having at least one flushing hole extending through the wall of the adaptor in which at least a region of the flushing hole is reinforced to strengthen the adaptor against bending, compression and/or tensional stresses.

BACKGROUND ART

Percussion drilling is a well-established technique that breaks rock by hammering impacts transferred from the rock drill bit, mounted at one end of a drill string, to the rock at the bottom of the borehole. The energy needed to break the rock is generated by a hydraulically driven piston that contacts a shank adaptor positioned at the opposite end of the drill string to the drill tool. The piston strike on the adaptor creates a stress (or shock) wave that propagates through the drill string and ultimately to the borehole rock bottom.

Shank adaptors typically comprise an internal bore to allow transfer of a flushing fluid to the region of the drill tool. The flushing fluid acts to both cool the tool and to expel drill cuttings and fines from the bore hole. Conventionally, the fluid is introduced into the shank adaptor via a radially extending hole in the adaptor wall that is submerged within a fluid tank that seals onto the external surface of the adaptor axially either side of the hole. Example shank adaptors with internal flushing bores are described in EP 1077305; WO 2013/109182; WO 2004/079152 and U.S. Pat. No. 4,094,364.

A common problem with existing shank adaptors is the susceptibility for the adaptor wall to fracture due to compressive and tensile stresses generated by the percussive piston and bending moments due to lateral deviation of the drill string during drilling, with the fault originating and propagating from the flushing hole. Shank adaptor failure is typically sudden and results in downtime of the drilling assembly. Whilst WO 2004/079152 discloses a flushing hole intended to reduce failure of the adaptor, there still exists a need for an adaptor having a flushing hole that further reduces or eliminates the likelihood of fracture in response to both compressive and tensile forces and bending moments.

SUMMARY OF THE INVENTION

It is an objective of the present invention to provide a rock drilling shank adaptor having an entry hole for the introduction of a flushing fluid into the adaptor configured to minimise or eliminate the likelihood of fracture of the adaptor wall via a crack propagating from the flushing hole. It is a further objective to provide a shank adaptor configured to withstand the tensile and compressive forces experienced at the region of the flushing hole. It is a further objective to provide a shank adaptor having a reinforced flushing hole to be resistant to bending moments transmitted through the adaptor. It is a further specific objective to provide a flushing hole configured to facilitate the guidance of flushing fluid from the external region surrounding the shank adaptor into the axially extending internal bore.

The objectives are achieved by forming a flushing hole extending radially through the wall of the adaptor, in communication with an axially extending internal bore, that is reinforced at an axially rearward region. Additionally, the present shank adaptor is configured for enhanced strength whilst not compromising or restricting fluid flow into the central bore by positioning the radially extending flushing hole at an axially rearwardmost end of the axially extending central bore.

The present flushing hole configuration is adapted so as to direct the flushing fluid in the axially forward direction within the central bore of the elongate adaptor. This is achieved via a radially inner portion at an axially rearward region of the flushing hole being reinforced so as to project into the flushing hole. In particular, a surface that defines the flushing hole at the rearward region is curved or angled inwardly into the volume of the flushing hole (extending radially through the adaptor wall) so as to be directed towards the hole surface at the axially forward region of the hole. Accordingly, a cross sectional area of the hole at a radially inner edge or side of the hole (positioned at the inner axial bore of the adaptor) is less than a corresponding cross sectional area of the hole at a radially outer edge or side of the hole (positioned at an external surface of the adaptor), where the respective cross sectional planes extend axially.

In particular, and according to a first aspect of the present invention there is provided a rock drilling shank adaptor comprising: an elongate body having a first end to be positioned towards a piston and a second end to be positioned towards a drill string; the body comprising an axially extending internal bore to allow passage of a flushing fluid to the drill string via the second end; a flush hole extending radially through the body to the internal bore, the hole having an axially forward region positioned closer to the second end than an axially rearward region positioned closer to the first end and having a radially external side positioned at an external surface of the adaptor and a radially internal side positioned at the internal bore, the external and internal sides coupled via a generally radially extending surface that defines the flush hole extending through the body; characterised in that: the flush hole at the axially rearward region is reinforced relative to the axially forward region in that in the radial direction from the external side to the internal side, the surface at the rearward region at least at a radially inner portion is curved or aligned transverse relative to a radially innermost portion of the surface of the hole at the axially forward region in the radial direction.

According to a further aspect of the present invention the rock drilling shank adaptor is characterised in that the flush hole at the axially rearward region is reinforced relative to the axially forward region wherein in the radial direction from the external side to the internal side, the surface at the rearward region at least at a radially inner portion is curved such that the surface at the rearward region at the internal side is positioned axially closer to the second end of the adaptor and/or the surface of the hole at the forward region than the surface of the rearward region at the external side.

According to a further aspect of the present invention, the rock drilling shank adaptor is characterised in that in a radial direction from the external side to the internal side, the surface at the rearward region at least at a radially inner portion is curved or aligned transverse relative to the orientation of the surface at the rearward region at a radially outer portion such that the surface at the rearward region at the internal side is positioned axially closer to the second end of the adaptor and/or the surface of the hole at the forward region than the surface of the rearward region at the external side.

Preferably, the wall surface is concave in a cross sectional plane extending perpendicular to the longitudinal axis of the adaptor at the radially inner portion. The wall surface at the rearward region of the hole may therefore be considered to define at least part of a concave channel extending radially from the external to internal sides. The concave curvature is advantageous to minimise stress concentrations and turbulence of the flushing fluid as it is introduced to the internal bore.

Preferably, the hole is defined at the external surface of the adaptor by an edge having a straight section provided at the axially forward region bordered at each end by a respective curved section. Preferably, the straight section is aligned generally perpendicular to the longitudinal axis of the adaptor. More preferably, the edge at the axially rearward region is concave in the axial direction such that the edge at the rearward region defines a part of an oval, an ellipse or a circle. Such configurations are beneficial to minimise stress concentrations at the external side of the flush holes where tensile and compressive forces may be greatest during use.

Preferably and in the radial direction, a radially outer portion of the wall surface at the axially rearward region is aligned generally perpendicular to the longitudinal axis of the adaptor or is aligned transverse or at a different orientation to the wall surface at the radially inner portion. The relative difference in the orientation (angular alignment) of the surface of the hole at the radially outer and inner regions is advantageous to achieve the desired hole geometry and in particular to limit the cross sectional area or size of the hole at the external surface of the adaptor. The relative cross sectional areas of the hole at the internal and external sides is advantageous to minimise stress and in particular to maximise resistance to bending without compromising the flow rate of flushing fluid transmitted to the internal bore through the flushing holes.

Optionally, a width of the hole in a direction perpendicular to a longitudinal axis of the adaptor at the external surface is equal to or less than a diameter of the internal bore. Such a configuration is further advantageous to achieve the desired balance between minimising stress concentrations and maximising the efficiency with which flushing fluid is introduced into the internal bore.

Preferably, the flush hole is positioned at an axially rearwardmost end of the internal bore such that the axially rearward region of the hole represents an axially rearwardmost end or extension of the internal bore that curves or is angled radially outward towards the external surface of the adaptor. Such a configuration is advantageous to reinforce the adaptor at the axially rearward region of the flush holes so as to enhance the strength against bending moments. This configuration is further advantageous to minimise turbulence within the rearward region of the internal bore as the fluid is introduced into the internal bore. According to the preferred configuration, the radial junction, at the centre of the adaptor between the diametrically opposed internal bores defines a cone or a truncated conical section that projects axially into the internal bore from an axially rearwardmost end of the internal bore.

Preferably, a radius of the curved inner portion is not less than 5, 10, 15 or 20 mm. Such an arrangement is beneficial to achieve the desired guidance of flushing fluid axially forward into the internal bore and to minimise stress concentrations that would otherwise arise due to sudden changes in the geometry and/or angular construction of the flush hole in the radial direction.

The adaptor further comprises side sections extending axially between the axially forward and rearward regions to complete the hole to form a closed loop. Preferably, the side sections may be generally straight and aligned generally parallel to a longitudinal axis of the adaptor.

Preferably, the adaptor comprises not more than two flush holes each comprising the radially inner portion that is curved or aligned transverse. Increasing the number of holes above two weakens the adaptor against bending moments and enhances the stress concentrations due to tensile and compressive forces. The present adaptor may comprise a single flush hole. However, two flush holes are preferred to optimise the adaptor for enhanced rate of flow of flushing fluid into the internal bore. Preferably, the two holes are positioned diametrically opposite one another in fluid communication with the internal bore. Such a configuration is advantageous to minimise stress concentrations and to provide a symmetrical adaptor body that is strengthened at the radial junction of flush holes and the internal bore. This relative orientation of the holes also avoids a non-central mass distribution about the longitudinal axis of the adaptor which may otherwise be detrimental as the adaptor as it is rotated during use.

According to a further aspect of the present invention there is provided rock drilling apparatus comprising a shank adaptor as claimed herein. Optionally, the apparatus further comprises an elongate piston having a main length and an energy transmission end to contact the first end of the adaptor; and a drill string formed from a plurality of coupled elongate drill rods, wherein a rearwardmost drill rod of the drill string is coupled to the second end of the adaptor.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
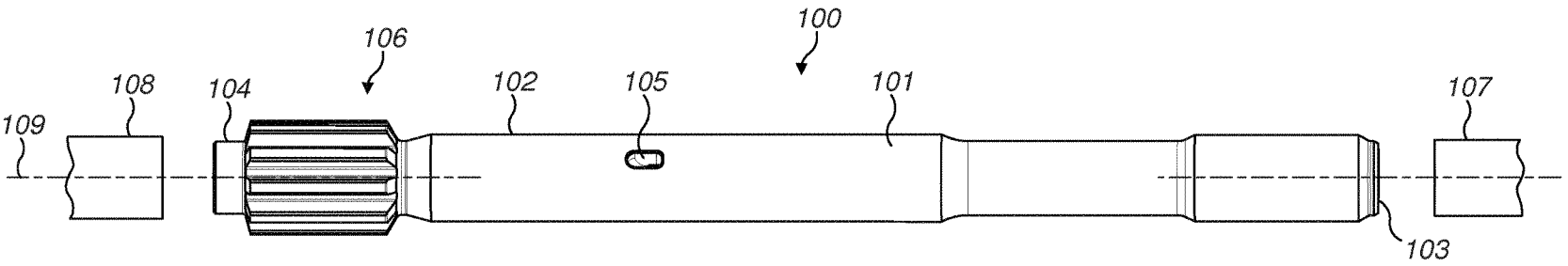
FIG. 1 is an external perspective view of a shank adaptor forming part of rock drilling apparatus also comprising an elongate drill string and a hydraulically driven reciprocating piston according to a specific implementation of the present invention.

Referring to FIG. 1, rock drilling apparatus comprises an elongate energy transmission adaptor 100 comprising a main body (or length section) 101 having a forward end 103 and a rearward end 104 relative to a longitudinal axis 109. A plurality of axially parallel elongate splines 106 project radially outward from an external surface 102 at a rearward region of elongate main body 101 towards rearward end 104. Splines 106 are configured to be engaged by corresponding splines of a rotational motor (not shown) to induce rotation of adaptor 100 about axis 109 during drilling operations. Adaptor 100 further comprises a pair of flush holes (alternatively termed flush bores) 105 positioned axially between ends 103, 104 and extending radially through the adaptor main body 101 from external surface 102 to an internal cavity or region extending axially within adaptor 100.

Adaptor 100 is configured for coupling to an elongate drill string and to allow transmission of a stress wave to a drill tool (not shown) located at the deepest region of the drill hole to impart the percussion drilling action. In particular, adaptor forward end 103 may be coupled to a rearward end of a rearward elongate drill rod 107 forming a part of the drill string. The adaptor rearward end 104 is configured to be contacted by a hydraulically driven piston 108 that creates the stress wave within adaptor 100 and the drill string. Such apparatus further comprises a flushing fluid tank and associated seals, valves and pumps (not shown) positioned external around adaptor surface 102 such that flush holes 105 are contained within the tank to allow introduction of the fluid into adaptor 100 and subsequently axially through the elongate drill rods 107.

Figure 2:
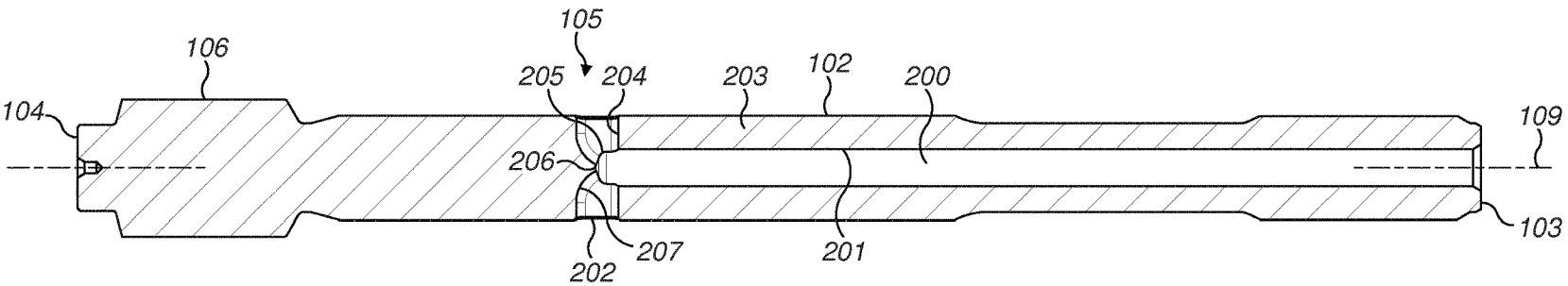
FIG. 2 is a cross sectional side view through the shank adaptor of FIG. 1 according to a specific implementation of the present invention.
Figure 3:
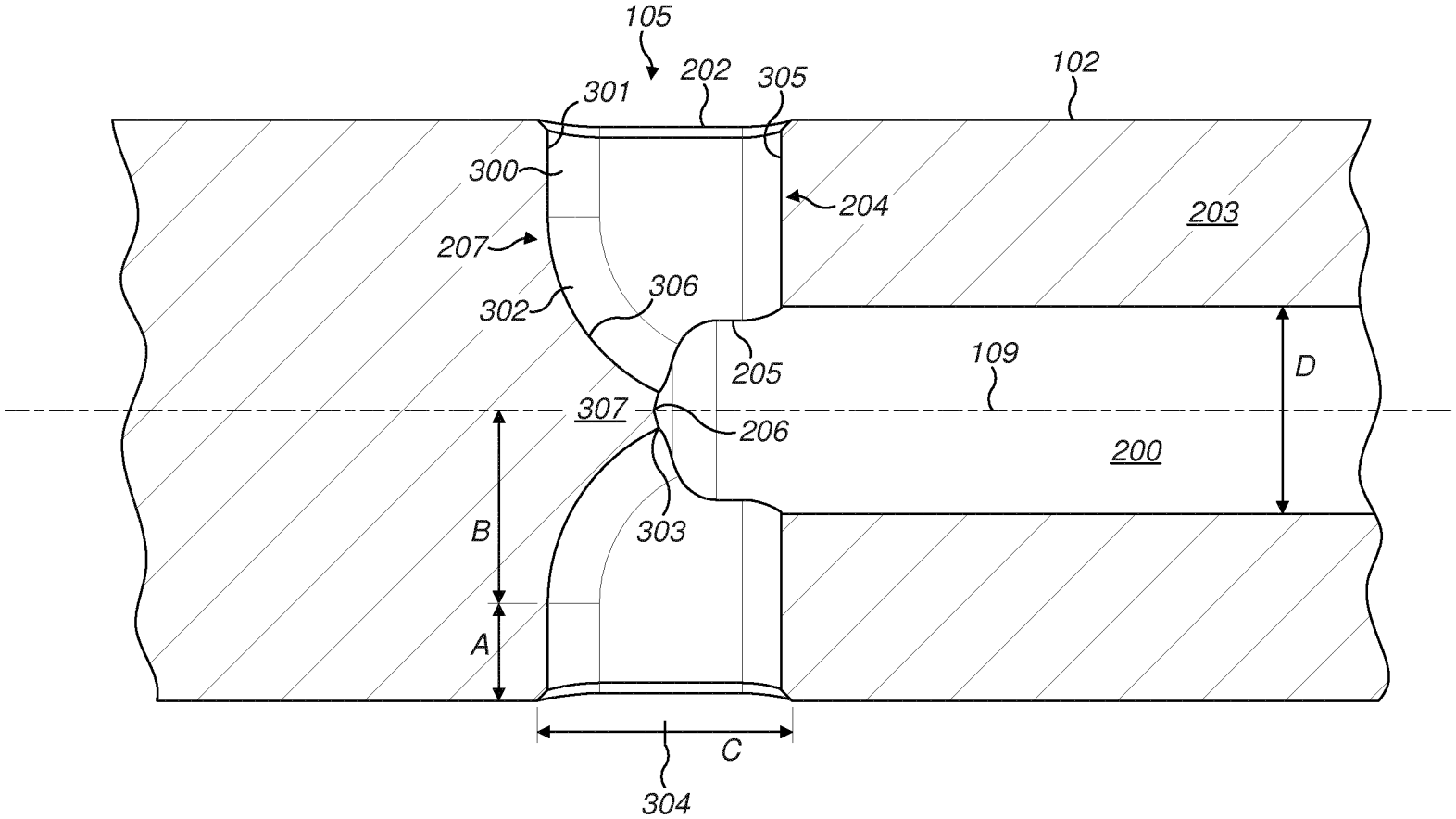
FIG. 3 is a magnified cross sectional view through a pair of flush holes extending through the adaptor wall and in communication with and axially extending internal bore according to the specific implementation of FIG. 2.

Referring to FIGS. 2 and 3, adaptor 100 comprises an internal elongate bore 200 extending axially through a majority of the axial length of adaptor 100 between forward end 103 and flush holes 105, the bore 200 being defined by a generally cylindrical internal facing surface 201. According to the specific implementation, the pair of diametrically opposed flush holes 105 are provided at a rearwardmost end 206 of bore 200 and effectively terminate bore 200 at a position closest to adaptor rearward end 104 relative to adaptor forward end 103. Each flush hole 105 extends radially through the generally cylindrical wall 203 at adaptor 100 between an external surface 102 and internal bore 200. Accordingly, each hole 105 comprises an external edge 202 positioned coplanar with external surface 102 and an internal edge 205 positioned at the interface with internal bore 200. Each flush hole 105 comprises an axially forward region indicated generally by reference 204 and an axially rearward region indicated generally by reference 207.

Figure 4:
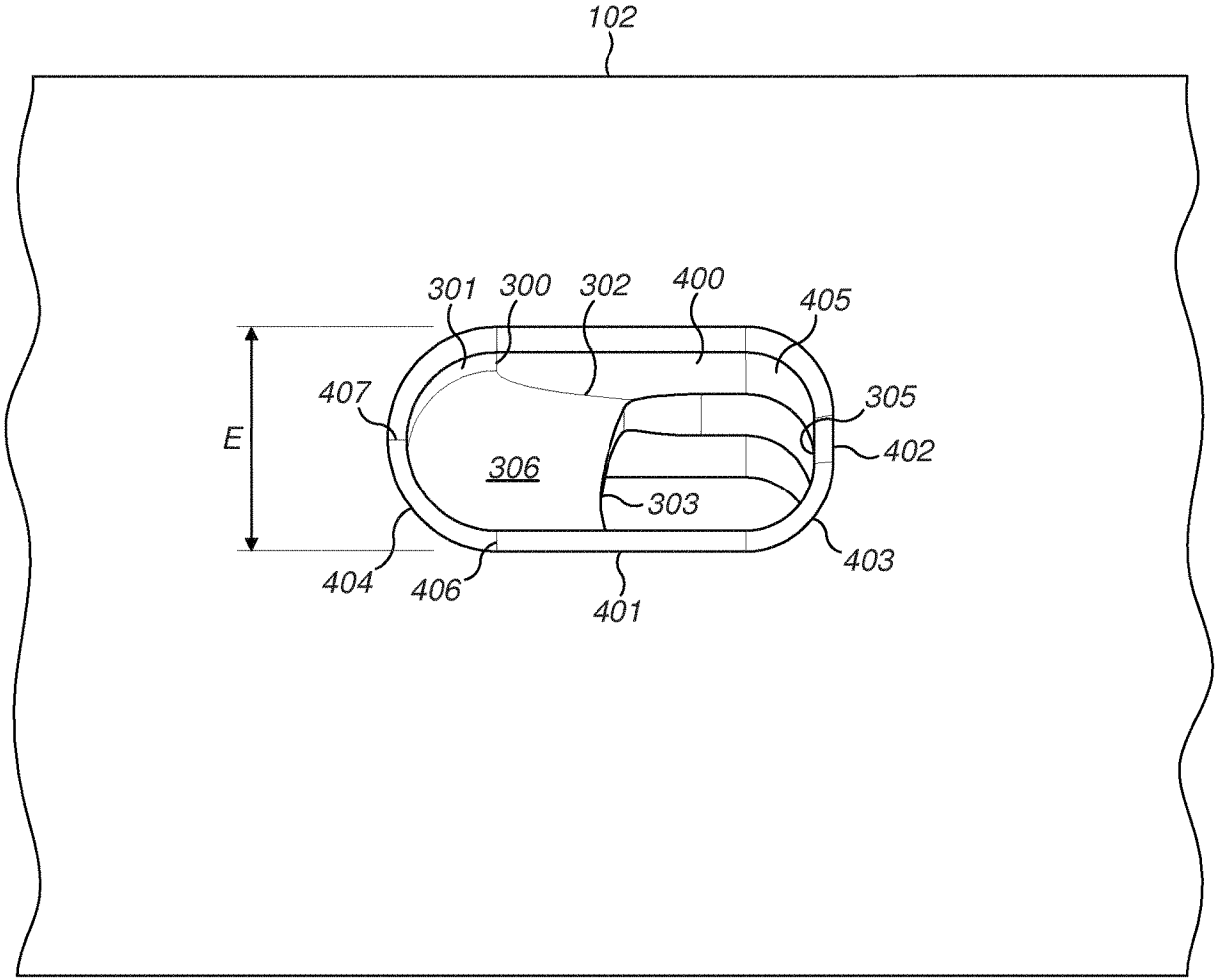
FIG. 4 is an external perspective view of one of the flushing holes of FIG. 3.

Referring to FIGS. 3 and 4, each hole 105 extending through adaptor wall 203 is defined by a plurality of surface regions that collectively define a closed loop bore between external edge 202 and an internal edge 205. In particular, hole 105 comprises a forwardmost surface 305 aligned perpendicular to axis 109. Surface 305 extends the full radial distance between external and internal edges 202, 205 and is bordered at each end in the widthwise direction across adaptor 100 (perpendicular to axis 109) by a pair of curved surfaces 405 that extend axially rearward from surface 305 towards rearwardmost region 207. Hole 105 further comprises a pair of parallel lengthwise extending surfaces 400 aligned generally parallel to axis 109 and generally perpendicular to forwardmost surface 305. A rearwardmost end 406 of lengthwise extending surfaces 400 transitions into a curved surface 301 being concave in a cross sectional plane of adaptor 100 (extending perpendicular to axis 109). The surface of the hole 105 at the rearwardmost region 207 may be considered to be divided into a radially outer region indicated generally by reference 300 and a radially inner region indicated generally by reference 302. The surface 301 at the radially outer region 300 in a plane perpendicular to axis 109 is semi-circular according to the specific implementation of the present invention and provides a smooth curving transition into the hole lengthwise extending surfaces 400. In the radial direction between external and internal edges 202, 205 surface 301 at the rearwardmost and radially outermost region 300 is aligned perpendicular to axis 109 and generally parallel to forwardmost surface 305. Accordingly, a cross sectional area of each hole 105 in the radial direction is substantially uniform within the radially outer region 300 between the outer edge 202 and the radially inner region 302. The cross sectional area of each hole 105 then decreases in the radially inward direction from external edge 202 to internal edge 205 within the radially inner region 302. This decrease in the cross sectional area is provided by the surface of hole 105 at the axially rearward region 207 being curved in the axial direction from rearward end 104 towards forward end 103. That is, the cross sectional area of each hole 105 becomes increasingly constricted as the rearwardmost region 207 extends in the axial direction towards the adaptor forward end 103. Additionally, hole surface 306 at the radially inner region 302 is also concave (in a cross sectional plane of adaptor 100 extending perpendicular to axis 109) and comprises a radius of curvature corresponding to that of surface 301 at the radially outer region 300. A radially innermost end 303 of surface 306 at radially inner region 302 defines generally the region of the internal bore 200 at the axially rearwardmost end 206. Accordingly, the opposed radially inner regions 302 of the diametrically opposed holes 105 define a truncated conical section 307 aligned on a plane perpendicular to axis 109 having a concave external surface 306 with an apex centred on axis 109 that defines the rearwardmost end 206 of internal bore 200.

The curved radially inner region 302 of each hole 105 effectively strengthens the adaptor 100 at the radially inner region of each flushing hole 105 against stress concentrations and fatigue due to tensile and compressive forces transmitted axially through the adaptor 100 during use. The axially forward region 204 of each hole 105 is further strengthened against the compressive and tensile forces by the alignment of the forwardmost surface 305 being generally perpendicular to axis 109. The stress concentrations are also reduced by the shape profile of external edge 202 is illustrated in FIG. 4. In particular, the external edge 402 at the axially forwardmost region 204 of hole 105 is aligned perpendicular to axis 109. This is bordered at each widthwise end by respective curved edge sections 403 that curve axially rearward towards adaptor rearward end 104. Edge 202 is further defined by a pair of parallel and opposed lengthwise edge regions 401 that transition into a curved rearwardmost edge region 404 at the rearward region 207 of hole 105.

According to the specific implementation, a radial length A of the radially outer region 300 of hole surface 301 is less than the corresponding radial length B of the surface 306 of the radially inner region 302. In particular and according to the specific implementation, distance A is approximately half distance B. Surface 306 at the radially inner region 302 of each hole 105 is curved to extend axially forward over an angle of approximately 60°. Accordingly, the radially inner region 302 of each hole 105 at the axially rearward region 207 is curved in a direction towards adaptor forward end 103 by a distance that is approximately half of a total axial length C of each hole 105. That is, the radially innermost end 303 of radially inner region 302 is positioned generally at the mid length position 304 between forwardmost edge 402 and the rearwardmost section 407 of rearwardmost edge 404.

By strengthening the rearward region 207 of each hole 105, adaptor 100 is strengthened against compressive and tensile forces and also bending moments at the region of the flush holes 105. Additionally, by 'rounding' the inner region 302 of each hole 105, the flushing fluid is directed to flow axially into the central bore 200 in a direction towards adaptor forward end 103. Accordingly, any reduction in the cross sectional area of each hole 105 in the radial direction from external edge 202 to internal edge 205 (due to the curvature of the radially inner region 302) does not reduce the rate of fluid flow into the internal bore 200 when compared to conventional flushing hole configurations in which all regions of the hole surface are aligned perpendicular to axis 109. Additionally, providing two diametrically opposed flush holes 105 has been observed to reduce von Mises stresses appreciably and also to prevent bending of the shank adaptor 100 due to bending moments transmitted through the adaptor (being resultant from lateral deviations of the bit during drilling). Orientating the forwardmost surface 305 at the forward region 204 perpendicular to axis 109 whilst providing surface 306 at rearward region 207 that is curved, is effective to achieve the desired flow rate of flushing fluid into bore 200 whilst minimising the stress concentrations at the region of the adaptor 100 around the flush holes 105. According to the specific implementation, the desired flow rate and stress resistance is achieved with a flush hole 105 having a width E (as defined between opposed lengthwise surfaces 400) that is less than the diameter D of the axially extending internal bore 200. According to the specific implementation, the hole length C (as defined between rearwardmost surface 301 and forwardmost surface 305) is greater than hole width E. The enhanced strength (and resistance to stress concentrations) of each flushing hole 105 is achieved via the additional support at the radially inner region 302 of each hole 105 and in particular the conical section 307 at the rearwardmost end of the axially extending bore 200. The conical section 307 at the radial centre of the adaptor 100 and at the radial junction of the opposed flushing holes 105 acts to strengthen the adaptor 100 to minimise the tensional stresses. The curvature of surface 306 at radially inner regions 302 provide a smooth surface profile transition from the radially outer region 300 to radially innermost end 303 to minimise stress concentrations across the full radial length of each hole 105 between external edge 202 and internal edge 205.

The invention claimed is:

1. A rock drilling shank adaptor comprising:

an elongate body having a first end arranged to be positioned towards a piston and a second end arranged to be positioned towards a drill string, the body including an axially extending internal bore arranged to allow passage of a flushing fluid to the drill string via the second end; and a flush hole extending radially through the body to the internal bore, the hole having an axially forward region positioned closer to the second end than an axially rearward region positioned closer to the first end and having a radially external side positioned at an external surface of the adaptor and a radially internal side positioned at the internal bore, the external and internal sides being coupled via a generally radially extending hole surface that defines the flush hole extending through the body, the flush hole at the axially rearward region being reinforced relative to the axially forward region in the radial direction from the external side to the internal side, the surface at the rearward region at least at a radially inner portion being curved or aligned transverse relative to a radially innermost portion of the surface of the hole at the axially forward region in the radial direction such that a surface of the rearward region at the internal side is positioned axially closer to the second end than the surface of the rearward region at the external side.

2. The adaptor as claimed in claim 1, wherein the hole surface is concave in a cross sectional plane extending perpendicular to the longitudinal axis of the adaptor at the radially inner portion.

3. The adaptor as claimed in claim 1, wherein the hole is defined at the external surface of the adaptor by an edge having a straight section provided at the axially forward region bordered at each end by a respective curved section.

4. The adaptor as claimed in claim 3, wherein the straight section is aligned generally perpendicular to the longitudinal axis of the adaptor.

5. The adaptor as claimed in claim 3, wherein the edge at the axially rearward region is concave in the axial direction such that the edge at the rearward region defines a part of an oval, an ellipse or a circle.

6. The adaptor as claimed in claim 1, wherein in the radial direction a radially outer portion of the hole surface at the axially rearward region is aligned generally perpendicular to the longitudinal axis of the adaptor or is aligned transverse or at a different orientation to the hole surface at the radially inner portion.

7. The adaptor as claimed in claim 1, wherein a width of the hole in a direction perpendicular to a longitudinal axis of the adaptor at the external surface is equal to or less than a diameter of the internal bore.

8. The adaptor as claimed in claim 1, wherein the flush hole is positioned at an axially rearwardmost end of the internal bore such that the axially rearward region of the hole represents an axially rearwardmost extension of the internal bore that curves or is angled radially outward towards the external surface of the adaptor.

9. The adaptor as claimed in claim 1, wherein the surface at the axially forward region of the hole is aligned generally perpendicular to the axis such that a cross sectional area of the hole decreases from the external side to the internal side resultant from the curvature or angled orientation of the radially inner portion of the rearward region.

10. The adaptor as claimed in claim 1, wherein a radius of the curved inner portion is not less than 5 mm.

11. The adaptor as claimed in claim 1, further comprising side sections extending axially between the axially forward and rearward regions to complete the hole to form a closed loop, the side sections being generally straight and aligned generally parallel to a longitudinal axis of the adaptor.

12. The adaptor as claimed in claim 1, comprising not more than two flush holes each having the radially inner portion that is curved or aligned transverse.

13. The adaptor as claimed in claim 12, wherein the two holes are positioned diametrically opposite one another in fluid communication with the internal bore.

14. A rock drilling apparatus comprising a shank adaptor as claimed in claim 1.

15. The apparatus of claim 14, further comprising:

an elongate piston having a main length and an energy transmission end to contact the first end of the adaptor; and a drill string formed from a plurality of coupled elongate drill rods, wherein a rearwardmost drill rod of the drill string is coupled to the second end of the adaptor.

* * * * *